United States Patent [19]

Ookawa

[11] Patent Number: 4,895,359

[45] Date of Patent: Jan. 23, 1990

[54] PAPER SHEET COUNTER SYSTEM

[75] Inventor: Hiroyuki Ookawa, Tokyo, Japan

[73] Assignee: Musashi Engineering Kabushiki Kaishi, Tokyo, Japan

[21] Appl. No.: 308,569

[22] Filed: Feb. 9, 1989

Related U.S. Application Data

[63] Continuation-in-part of Ser. No. 162,606, Mar. 1, 1988, abandoned.

[51] Int. Cl.[4] ..... B65H 3/56

[52] U.S. Cl. ..... 271/125; 271/238; 271/251

[58] Field of Search ..... 271/121, 124, 125, 167, 271/251, 238, 239

[56] References Cited

U.S. PATENT DOCUMENTS 4,257,587 3/1981 Smith ..... 271/251 X
4,775,142 10/1988 Silverberg ..... 271/251

FOREIGN PATENT DOCUMENTS 2151587 7/1985 United Kingdom .

*Primary Examiner*—Richard A. Schacher
*Attorney, Agent, or Firm*—Brooks Haidt Haffner & Delahunty

[57] ABSTRACT

A paper sheet counter is provided in which a large number of paper sheets stacked in a hopper are fed one by one between a pay-out roll and separating rolls, and stacked in a stacker. According to the invention, the separating rolls have separating roll shafts angled slightly relative to a plane perpendicular to the axis of the pay-out roll.

8 Claims, 5 Drawing Sheets

PAPER SHEET COUNTER SYSTEM

BACKGROUND OF THE INVENTION

This application is a continuation in part of application Ser. No. 07/162,606, filed Mar. 1, 1988, for "Paper Sheet Counter System" now abandoned.

This invention relates to a paper sheet counter and more particularly to such counter adapted for increasing the contact area between the separating rolls and the paper sheets and improving the separating efficiency while minimizing the injury to the paper sheets.

PRIOR ART

There are a variety of sheet counters of the above type which are known and employed in the art. Typical of these is a system shown in FIGS. 1 to 5 although the identification of literature showing its structure is not given herein.

In the prior-art system shown in FIG. 1, a pay-out roll 3 and a separating roll 4 are provided at one side of a hopper 2 which is adapted to hold a large number of stacked sheets 1. The rolls 3 and 4 are arranged to be rotated in the same direction. A pay-out shaft 3*a* of the pay-out roll 3 and a separating roll shaft 4*a* of the separating roll 4 are provided extending parallel to each other.

An auxiliary feed roll 5 is provided near the lower surface of the hopper 2 arranged to be turned in the direction of the arrow mark. The outer peripheral surfaces of the rolls 3 and 5 are partially lined with friction members 3*b*, 5*a*, formed of high friction materials, such as rubber, respectively.

As shown in FIG. 2, the rolls 3 and 4 are designed to overlap with each other over an extent l, with the separating roll 4 intruding into a groove 3*c* formed on the peripheral surface of the pay-out roll 3 to obstruct the passage of the sheets. It is only when the frictional force of the frictional member 3*b* of the pay-out roll 3 overcomes the obstructive force of the separating roll 4 that the sheets are transported past these rolls 3, 4.

In the prior-art system shown in FIG. 3, the separating roll 4 is coupled to the separating roll shaft 4*a* through a one-way clutch 6 so as to be turned only in one direction and is adapted to be turned stepwise through a predetermined angle each time under a torque produced by an electric motor, a solenoid, a spring or by vibrations for operating only in one direction.

By rotating the separating roll 4 stepwise through a predetermined angle each time for separating the sheets, a plurality of pressure contact zones 4*b* with the sheets 1 are formed at equiangular intervals on the perimeter of the roll 4 to prevent partial attrition or wear of the roll 4.

The above-described prior-art paper sheet counter has the following deficiencies.

(i) Since the force to transport the paper sheets is generated only by the friction member of the pay-out roll, adjustment of the overlap state between the pay-out roll and the separating rolls becomes extremely delicate such that only a small adjustment between the shafts results in a larger variation in the overlap state. Thus it becomes necessary to make a delicate adjustment of the overlap extent depending upon the thickness and the degree of injury of the paper sheets.

(ii) The separating rolls need be precisely positioned centrally in the groove of the pay-out roll, and a great deal of skill and labor time is required in the positioning adjustment during assembling. In addition, because the separating roll is disposed within the groove, fold marks are formed in the paper sheets in a direction parallel to the sheet transport direction causing considerable deterioration in the appearance of the paper sheets after counting.

(iii) Since the surface of the separating rolls contacted by the paper sheets is arcuate as shown in FIGS. 4 and 5, the paper sheets tend to be folded along the arcuate surface of the separating roll that is being rotated in a direction opposite to the transport direction of the paper sheets, when the paper sheets enter the gap between the separating roll and the pay-out roll. When the paper sheets are transported further in the direction of the arrow mark, they are transported in the folded state to obstruct the transport and deteriorate the appearance of the paper sheets.

(iv) In the prior-art system shown in FIG. 3, the separating rolls need be turned stepwise through a predetermined angle each time by drive means for preventing partial wear of the separating rolls. This results in a complicated system structure through the use of the one-way clutch and drive means and increased costs in production and maintenance.

It is an object of the present invention to provide a paper sheet counter which is devoid of the above enumerated deficiencies and in which the contact area between the separating rolls and the paper sheets is increased to improve the separating efficiency and to minimize the injury to the paper sheets.

In accordance with the present invention, there is provided a paper sheet counter in which a large number of paper sheets stacked in a hopper are fed one by one by a pay-out roll and separating rolls, counted, and stacked in a stacker, wherein said separating rolls have separating roll shafts whose axes are angled slightly relative to a plane that is perpendicular to the axis of said pay-out roll and are in the form of rolls having an axial length as required.

In the paper sheet counter of the present invention, the separating roll has a longitudinal cylindrical form, and has its axial direction angled slightly from the orthogonal to the axial direction of the pay-out roll, such that the overlap extent between the separating roll and the pay-out roll is markedly improved to assure an extremely stable separation and pay-out of the paper sheets. In addition, the separating rolls may be of any desired roll configuration longitudinally, so that the contact area between the separating rolls and the paper sheets is increased to increase the separating efficiency Since a narrow passage is defined between the pay-out roll and the separating roll, the paper sheets placed between the rolls are not permitted to proceed in a direction opposite to the transport direction so that the paper sheets are transported safely and reliably without becoming folded at the forward portions of the paper sheets.

Also, since the separating rolls may be turned about the separating roll shafts, the outer peripheral surface of the separating rolls is worn uniformly to prevent malfunctions that would occur otherwise.

BRIEF DESCRIPTION OF THE DRAWINGS

FIGS. 1 to 5 illustrate the prior-art construction, wherein FIG. 1 is a diagrammatic view of the overall system.

FIGS. 2 and 3 are diagrammatic views showing the overlap state of the rolls.

FIGS. 4 and 5 are diagrammatic views showing the state of separating the paper sheets.

FIGS. 6 to 16 illustrate the paper sheet counter in accordance with the present invention, wherein FIG. 6 is a sectional view showing the overall construction.

FIG. 7 is a rear view showing the essential parts of FIG. 6.

FIG. 8 is an enlarged sectional view showing essential parts of FIG. 6.

FIG. 9 is a side elevation showing the separating roll and the pay-out roll.

FIG. 10 is a plan view of FIG. 9.

FIG. 11 is a sectional view, as seen from the lateral side of FIG. 9.

FIGS. 12 and 13 are diagrammatic views showing the overlap state.

DESCRIPTION OF THE PREFERRED EMBODIMENT

Figure 1:
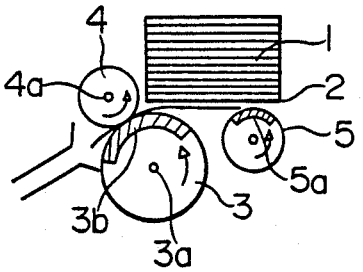
FIG. 1 (PRIOR ART)
Figure 2:
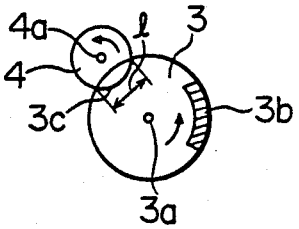
FIG. 2 (PRIOR ART)
Figure 3:
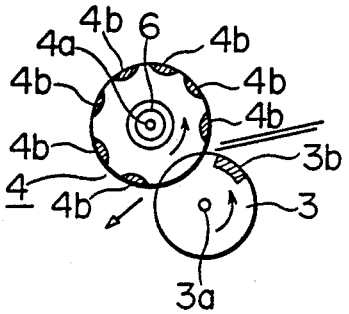
FIG. 3 (PRIOR ART)
Figure 4:
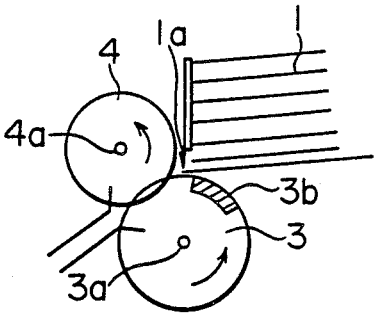
FIG. 4 (PRIOR ART)
Figure 5:
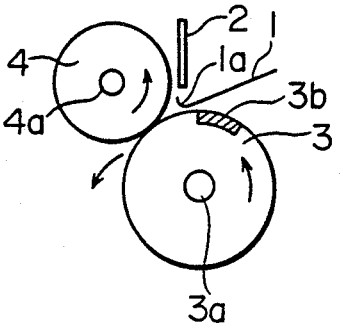
FIG. 5 (PRIOR ART)

Referring to the accompanying drawings, the paper sheet counter according to the present invention will be explained in detail. It is noted that the same numerals are used throughout the drawings to depict the parts or components that are the same as, or equivalent to, those of the above described prior art system.

In the drawings, the numeral 1 denotes paper sheets stacked in a hopper 2, and a hopper supplemental plate 9*a* which aligns one end of said paper sheets 1 is detachably mounted on a main body 7 by a nut 8.

A pay-out roll 3 and an auxiliary feed roll 5 are rotatably mounted at the lower portion of the hopper 2 within the main body 7. The outer peripheral surface of the auxiliary feed roll 5 is partially intruded via a through-hole, not shown, formed in the hopper 2, to come into abutment with the reverse side of the bottom sheet 1 placed in the hopper 2.

A friction member 3*b* formed by a high friction material such as rubber is formed on a portion of the peripheral surface of the pay-out roll 3. The paper sheets 1 are fed one by one by the operation of the friction member 3*b*.

On the back side of the pay-out roll 3, a separating roll holding unit 9 including a pair of separating rolls 4 each in the form of a cylinder and a guide roll 4*b* is mounted for opening and closing in the direction of an arrow mark A by a pivot shaft 10 provided to the main body 7.

The separating roll shafts 4*a* for holding the separating rolls 4 are mounted on a holding member 11 provided on the holding unit 9, and a tension spring 24 is installed between the ends of these roll shafts 4*a*.

Figure 7:
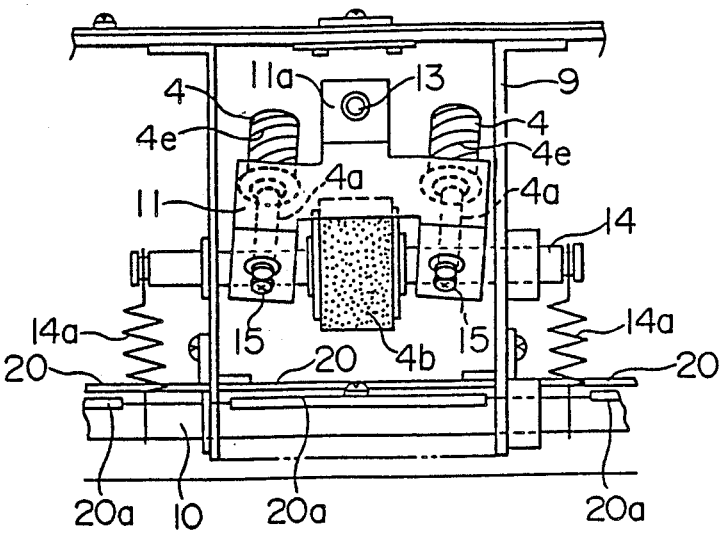
Figure 8:
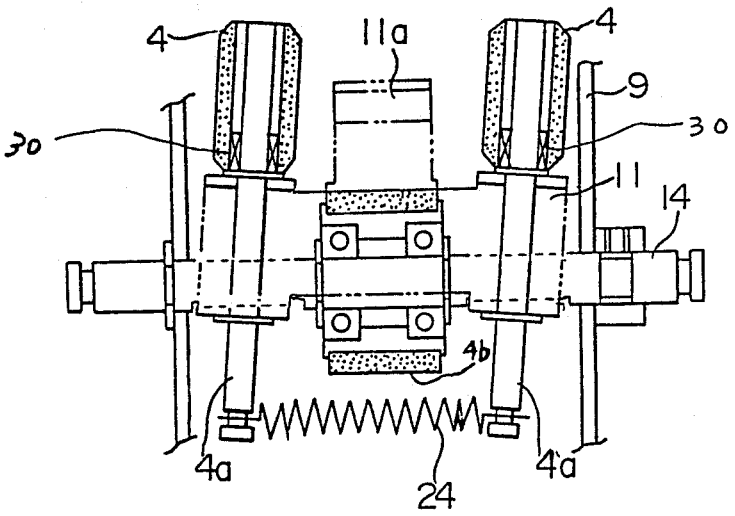
Figure 8A:
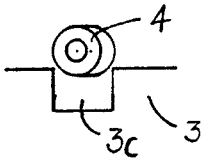
FIG. 8A is an enlarged fragmentary view showing the relation of the separating roll to the groove in the pay-out roll and the intrusion of the former into the latter.
Figure 8B:
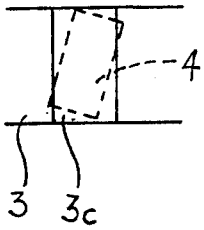
FIG. 8B is a top plan view of the rolls shown in FIG. 8A but with the separating roll shown in broken lines for the sake of clarity.

The axial direction of the separating roll shafts 4*a* of the separating rolls 4 is not quite at right angle to the axis of the pay-out roll shaft 3*a* of the pay-out roll 3. The separating rolls 4 are provided as a pair and are removably mounted on the separating roll shafts 4*a*, as shown in FIGS. 7 and 8. These separating rolls 4 are maintained in an overlapping relation in a pair of circumferential grooves 3*c* formed on the peripheral surface of the pay-out roll 3, as shown in FIGS. 8A, 8B, 10 and 11.

Consequently, an elongated passage is formed between the separating rolls 4 and the pay-out roll 3.

From FIGS. 7, 8, 10 and 11 it should be apparent that the longitudinal axes of the shafts 4*a*, 4*a* for the rolls 4, 4 are inclined or angled slightly relative to a plane that is perpendicular to the axis of the pay-out roller 3. Also, from FIGS. 8A and 8B, it should be understood that the separating roll 4 is always positioned so as to provide a predetermined gap between the outer peripheral surface of the separating roll 4 and the grooves 3*c* of the pay-out roll 3 for enabling paper sheets 1 to pass through said gap therebetween. This arrangement ensures that when a paper sheet is fed between rolls 3 and 4, positive separation from any additional sheets is obtained and transport of the desired sheet 1 is assured.

Referring again to FIGS. 7 and 8, a connecting portion 11*a* is formed as an upper extension from the holding member 11. A screw member 13 connected integrally to a dial 12 and rotatably mounted on the holding unit 9 is threadedly coupled to the extension 11*a*. The holding member 11 is retained by a supporting shaft 14 retained by the holding unit and biased by springs 14*a*, 14*a*. By turning the screw member 13 by operating the dial 12, the separating roll shaft 4*a* is shifted slightly in the direction of the arrow mark B for adjusting the relative distance or gap between the separating roll 4 and the pay-out roll 3. The guide roll 4*b* is rotatably mounted on supporting shaft 14 and abuts the pay-out roll 3.

The dial 12 and the screw member 13 make up means 16 for changing the relative distance between the rolls 3 and 4.

The separating roll 4 need not be in the form of a cylinder, but may also be in the form of a drum or a core or a combination of a cylinder and a drum as shown in FIGS. 13 to 16. Further, a coarse face portion 4*e* such as a spiral groove is formed in a cw or ccw direction as shown in FIG. 7. As shown in FIGS. 7, 8, 10 and 11, the separating roll shafts 4*a* are tilted or angled slightly from orthogonality with respect to the roll shaft 3*a*. Although as viewed in FIGS. 7 and 8, the shafts 4*a* are shown angled or tilted to the right, it should be understood that they could be tilted an equal angle to the left. (See FIG. 6.)

A pair of paper sheet feed rolls 17, 18 are arranged below the pay-out roll 3 for rotation in contact with each other. A pair of juxtaposed impellers 19, 19, only one being shown, are rotatably mounted at a position below the rolls 17, 18. The paper sheets 1 paid out from the pay-out roll 3 are supplied to the impellers 19, 19 through guide members 20, 20*a*.

The auxiliary feed roll 5, pay-out roll 3, paper sheet feed rolls 17, 18 and the impellers 19, 19 are driven in unison by a driving electric motor 21 mounted on the bottom 7*a* of the main body 7.

On the front side of the main body 7 adjacent to the impellers 19, a stacker 22 having an overall configuration substantially in the form of a letter L is mounted for opening and closing between dotted and solid line positions in the direction of the arrow mark C on a pivot shaft 23 supported by the main body 7.

Figure 6:
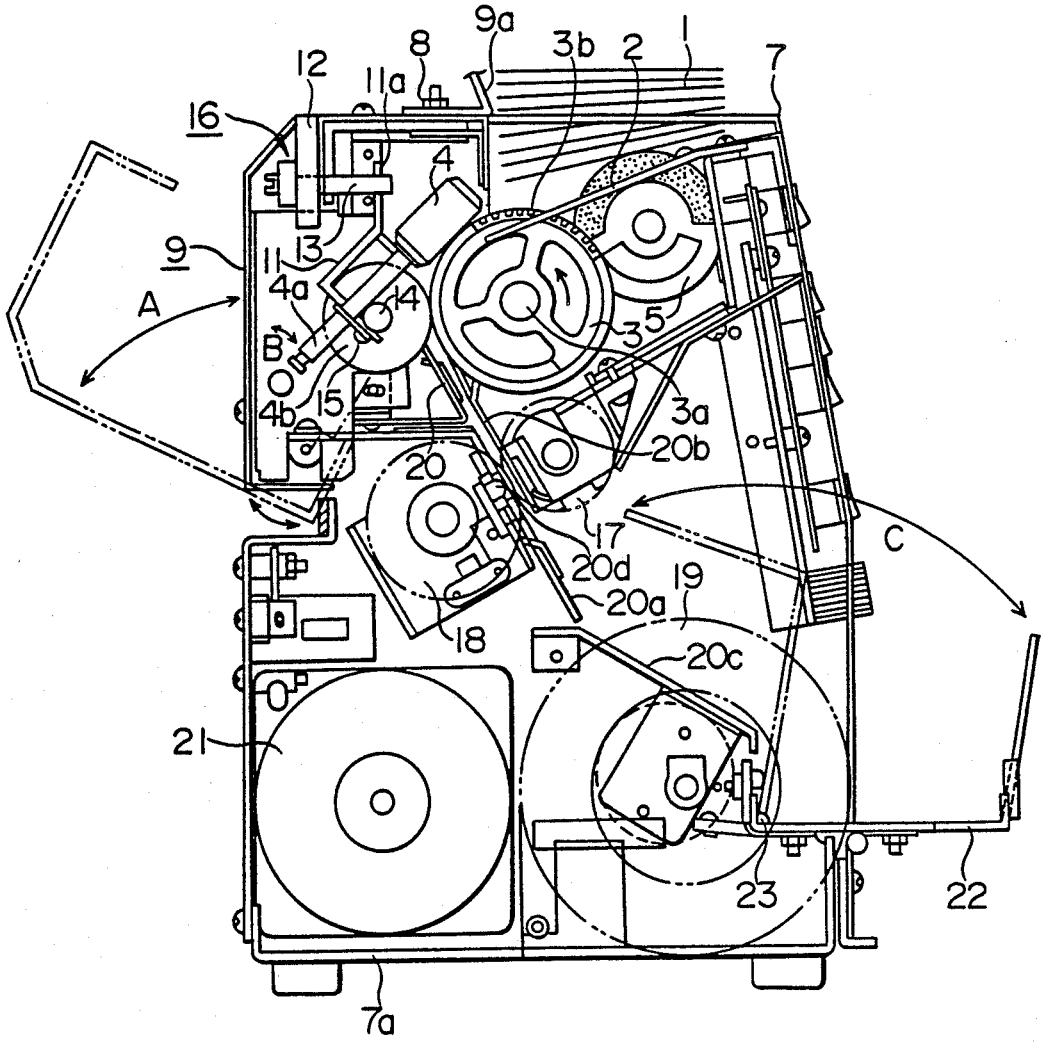

The paper sheet counter of the present invention, so far shown and described, operates as follows:

In the state shown in FIG. 6, the stacker 22 is opened as shown by the solid lines, and the driving motor 21 is actuated to start rotation of the auxiliary feed roll 5, pay-out roll 3, paper sheet feed rolls 17, 18 and impellers 19, 19. Simultaneously, the paper sheets 1 resting in the hopper 2 are taken out by the auxiliary feed roll 5, the lowermost sheet first, and sequentially fed towards the pay-out roll 3.

Figure 9:
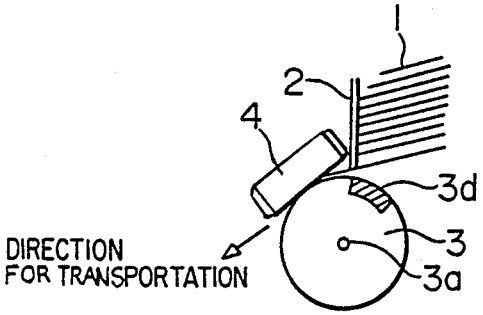
Figure 10:
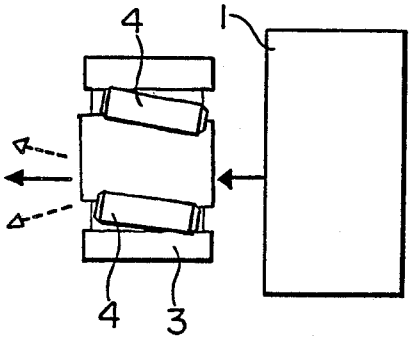
Figure 11:
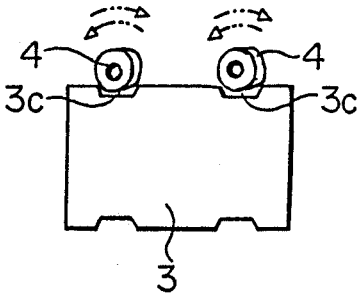

The paper sheets 1 fed towards the pay-out roll 3 as shown in FIGS. 9 to 11 are sandwiched between the respective separating roll 4 and the corresponding groove 3*c* and supplied through the narrow passage towards the paper sheet feed rolls 17, 18 after having been subjected to the frictional separating action of the separating rolls 4 and the friction members 3*b* of the pay-out roll 3. It is noted that due to the frictional area between the paper sheets 1 and the outer periphery of the rolls 4, as well as the angling of the axes of the separating roll shafts 4*a*, 4*a*, sheet separating efficiency is improved significantly. On the other hand, the outer peripheral surface of the separating roll 4 engages the paper sheets 1 with the longitudinal axis of the roll generally parallel to the direction of feed so that injury to the paper sheets 1 is minimized.

Referring to FIGS. 9, 10 and 11, it will be understood that as the sheet 1 is dragged by contact with the friction surface 3*b* of pay-out roll 3 along under separating rolls 4, 4, that are not power driven, the sheet 1 will frictionally engage the surfaces of rolls 4 imparting vector force component to rolls 4 tending to rotate the rolls 4 about their respective shafts 4*a*. While the rotation of separating rolls 4, 4 is slight for each sheet 1 passing thereunder, the rotation is sufficient to prevent uneven abrasion or wear of the peripheral surfaces of the separating rolls 4, 4.

If desired, one-way clutches 30, 30 can be incorporated between separating rolls 4, 4 and their respective shafts 4*a*, 4*a* as shown in FIG. 8. The clutches ensure that the rolls 4, 4 rotate in the required direction for allowing passage of the desired sheet 1 being fed by roll 3 when a single sheet 1 is being transported. It also ensures positive rotation of rolls 4, 4 to minimize uneven wear.

The paper sheets thus separated into individual sheets are detected and counted optically or magnetically by a paper sheet counter-sensor 20*d* when passing through guide members 20, 20*a*–20*c* before being arranged longitudinally and fed into the stacker 22 by the impellers 19, 19.

Figure 12:
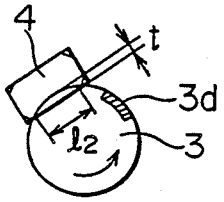
Figure 13:
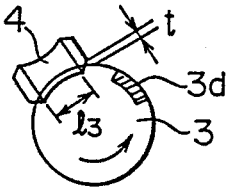

In general, the larger the relative distance or gap between the separating rolls 4 and the pay-out roll 3, and the larger the overlap extent, the higher the paper sheet separating efficiency. For the constant radial overlap extent t, the circumferential overlap extent $l_2$ is larger than in the prior art system, as shown in FIGS. 12 and 13. When the separating roll 4 is drum-shaped, as shown in FIG. 13, the periphery thereof is arcuate, the circumferential overlap $l_3$ is greater than with a straight type roll, whereby it is able to obtain a preferable sheet separation.

Figure 14:
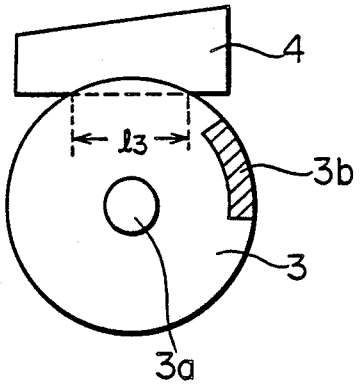

As shown in FIG. 14, when said separating roller 4 is shaped as a cone, an overlap amount $l_3$ against said pay-out roll 3 is increased thereby enabling good separating operation.

Figure 15:
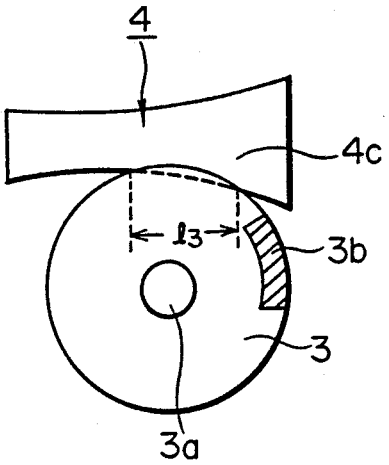

Further, as shown in FIG. 15, one end 4*c* thereof is formed by a trumpet and is overlapped to said pay-out roll 3 thereby enabling a large overlap amount $l_3$.

Figure 16:
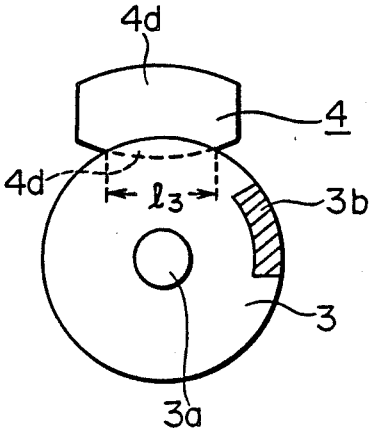

On the other hand, FIG. 16 shows a separating roll 4 shaped as a drum having an enlarged central portion 4*d*. The peripheral portion of said enlarged portion 4*d* overlaps said pay-out roll 3, thereby enabling a large overlapping amount $l_3$.

In general it is preferred that the paper sheet 1 be transported between the pay-out roll 3 and the separating rolls 4 along a straight path as shown by the bold-lined arrows in FIG. 10. However, the paper sheet 1 tends to be deflected slightly in the directions shown by the dotted-line arrow marks on account of variable paper sheet thickness or inevitable fluctuations in roll precision or assembling. For linear transport of the paper sheets, it is preferred that the separating rolls 4 be rotatable and tilted slightly from true orthogonality, as described above.

What is claimed is:

1. In a paper sheet counter in which a large number of paper sheets stacked in a hopper are fed one by one between a pay-out roll and separating rolls, counted, and stacked in a stacker, the improvement which comprises a pair of separating rolls each mounted for rotation on a respective separating roll shaft where said separating roll shafts are supported with their longitudinal axes in parallel with each other, at a slight angle relative to a plane perpendicular to the axis of the pay-out roll, and located to maintain said separating rolls spaced from said pay-out roll to provide a gap therebetween through which said paper sheets are passed, said gap being small enough to allow only one sheet to pass at a time while separating any additional sheets, and said angle is selected such that passage of a paper sheet causes rotation of said separating rolls.

2. The paper sheet counter according to claim 1 wherein said separating rolls are detachable from said separating roll shafts.

3. The paper sheet counter according to claim 1 wherein means are provided for changing the relative distance between said separating rolls and said pay-out roll.

4. The paper sheet counter according to claim 1 wherein said separating rolls are of a constant diameter along the axis thereof.

5. The paper sheet counter according to claim 1, wherein said separating rolls are drum shaped having an enlarged diameter central portion.

6. The paper sheet counter according to claim 1, wherein said separating rolls have coarse face portions.

7. The paper sheet counter according to claim 6, wherein said coarse portions are formed by one or more grooves.

8. The paper sheet counter according to claim 7, wherein said one or more grooves are of spiral form.

* * * * *